US010435643B2

(12) United States Patent
Hosseini et al.

(10) Patent No.: US 10,435,643 B2
(45) Date of Patent: Oct. 8, 2019

(54) LUBRICATING OIL COMPOSITIONS CONTAINING AMINE COMPOUNDS HAVING IMPROVED SEAL PERFORMANCE

(71) Applicant: Chevron Oronite Company LLC, San Ramon, CA (US)

(72) Inventors: Seyedeh Mahboobeh Hosseini, Richmond, CA (US); John Robert Miller, San Rafael, CA (US); Kevin David Carabell, Fairfax, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 194 days.

(21) Appl. No.: 15/450,778

(22) Filed: Mar. 6, 2017

(65) Prior Publication Data

US 2018/0251696 A1 Sep. 6, 2018

(51) Int. Cl.
*C10M 141/06* (2006.01)

(52) U.S. Cl.
CPC .... *C10M 141/06* (2013.01); *C10M 2207/021* (2013.01); *C10M 2207/026* (2013.01); *C10M 2207/123* (2013.01); *C10M 2215/04* (2013.01); *C10M 2215/042* (2013.01); *C10M 2215/064* (2013.01); *C10M 2215/22* (2013.01); *C10M 2215/221* (2013.01); *C10M 2215/28* (2013.01); *C10M 2219/044* (2013.01); *C10M 2219/046* (2013.01); *C10M 2223/045* (2013.01); *C10M 2227/09* (2013.01); *C10N 2220/021* (2013.01); *C10N 2230/36* (2013.01); *C10N 2230/52* (2013.01); *C10N 2240/10* (2013.01)

(58) Field of Classification Search
CPC ..... C10M 133/40; C10M 133/06; C10M 129/68; C10M 2203/1006; C10M 2215/04; C10M 2215/221; C10M 2207/28; C10N 2240/10; C10N 2230/52; C10N 2230/36; C10N 2220/021
See application file for complete search history.

(56) References Cited

U.S. PATENT DOCUMENTS

| | | | | |
|---|---|---|---|---|
| 4,085,126 | A | 4/1978 | McConnell et al. | |
| 4,320,019 | A | 3/1982 | Hayashi | |
| 4,615,818 | A * | 10/1986 | DiBiase | C10M 141/08 508/334 |
| 5,356,550 | A * | 10/1994 | Cook | C10M 159/12 508/242 |
| 6,156,850 | A | 12/2000 | Harrison et al. | |
| 6,245,724 | B1 | 6/2001 | Skinner et al. | |
| 6,933,351 | B2 | 8/2005 | Michaud et al. | |
| 7,479,473 | B2 | 1/2009 | Queen | |
| 9,145,530 | B2 | 9/2015 | Bera et al. | |
| 2013/0252865 | A1 | 9/2013 | Hartley et al. | |
| 2014/0051621 | A1 | 2/2014 | DeSantis et al. | |
| 2014/0106996 | A1 | 4/2014 | DeSantis et al. | |

* cited by examiner

*Primary Examiner* — Cephia D Toomer
(74) *Attorney, Agent, or Firm* — Carlton Virassammy

(57) ABSTRACT

Provided is an internal combustion engine lubricating oil composition which comprises a major amount of an oil of lubricating viscosity; one or more oil soluble or oil dispersible organic acid anhydrides, said anhydride comprising at least one hydrocarbyl or hydrocarbylene moiety having from about 10 to about 400 carbon atoms; and an oil soluble or oil dispersible secondary hydrocarbylamine compound, a tertiary hydrocarbylamine compound, or combinations thereof. Also provided is a method for maintaining and/or increasing fresh oil TBN of a lubricating oil composition while at the same time improving seal performance in an internal combustion engine.

23 Claims, No Drawings

LUBRICATING OIL COMPOSITIONS CONTAINING AMINE COMPOUNDS HAVING IMPROVED SEAL PERFORMANCE

FIELD OF THE DISCLOSURE

The present disclosure generally relates to a lubricating oil composition having improved seal performance in an internal combustion engine. In particular, the disclosure relates to a lubricating oil composition containing amine compounds and a seal improvement agent.

SUMMARY OF THE DISCLOSURE

In accordance with one embodiment of the present disclosure, there is provided an internal combustion engine lubricating oil composition which comprises a major amount of an oil of lubricating viscosity; one or more oil soluble or oil dispersible organic acid anhydrides, said anhydride comprising at least one hydrocarbyl or hydrocarbylene moiety having from about 10 to about 400 carbon atoms; and an oil soluble or oil dispersible secondary hydrocarbylamine compound, a tertiary hydrocarbylamine compound, or combinations thereof.

Also provided is a method for maintaining fresh oil TBN of a lubricating oil composition while at the same time improving seal performance in an internal combustion engine.

Also provided is a method for increasing fresh oil TBN of a lubricating oil composition while at the same time improving seal performance in an internal combustion engine.

DETAILED DESCRIPTION OF THE DISCLOSURE

Definitions

As used herein, the following terms have the following meanings, unless expressly stated to the contrary:

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

As used herein, the terms "hydrocarbon", "hydrocarbyl" or "hydrocarbon based" mean that the group being described has predominantly hydrocarbon character within the context of this disclosure. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this disclosure, these groups may contain atoms other than, carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

It must be noted that as used in this specification and appended claims, the singular forms also include the plural unless the context clearly dictates otherwise. Thus the singular forms "a", "an", and "the" include the plural; for example "an amine" includes mixtures of amines of the same type. As another example the singular form "amine" is intended to include both singular and plural unless the context clearly indicates otherwise.

The term "Total Base Number" or "TBN" as used herein refers to the amount of base equivalent to milligrams of KOH in 1 gram of sample (mgKOH/g). Thus, higher TBN numbers reflect more alkaline products, and therefore a greater alkalinity reserve. The TBN of a sample can be determined by ASTM Test No. D2896-11 issued May 15, 2011 or any other equivalent procedure.

The present disclosure is directed to an internal combustion engine lubricating oil composition which comprises (a) a major amount of an oil of lubricating viscosity; (b) one or more oil soluble or oil dispersible organic acid anhydride, said anhydride comprises at least one hydrocarbyl or hydrocarbylene moiety having from about 10 to about 400 carbon atoms; and (c) an oil soluble or oil dispersible secondary hydrocarbylamine compound, a tertiary hydrocarbylamine compound, or combinations thereof.

Oil of Lubricating Viscosity

The neutral oil may be selected from Group I base stock, Group II base stock, Group III base stock, Group IV or poly-alpha-olefins (PAO), Group V, or base oil blends thereof. The base stock or base stock blend preferably has a saturate content of at least 65%, more preferably at least 75%; a sulfur content of less than 1%, preferably less than 0.6%, by weight; and a viscosity index of at least 85, preferably at least 100. These base stocks can be defined as follows:

Group I: base stocks containing less than 90% saturates and/or greater than 0.03% sulfur and having a viscosity index greater than or equal to 80 and less than 120 using test methods specified in Table 1 of the American Petroleum Institute (API) publication "Engine Oil Licensing and Certification Sheet" Industry Services Department, 14th Ed., December 1996, Addendum I, December 1998;

Group II: base stocks containing greater than or equal to 90% saturates and/or greater than 0.03% sulfur and having a viscosity index greater than or equal to 80 and less than 120 using test methods specified in Table 1 referenced above;

Group III: base stocks which are less than or equal to 0.03% sulfur, greater than or equal to 90% saturates, and greater than or equal to 120 using test methods specified in Table 1 referenced above.

Group IV: base stocks which comprise PAO's.

Group V: base stocks include all other base stocks not included in Group I, II, III, or IV.

For these definitions, saturates level can be determined by ASTM D 2007, the viscosity index can be determined by ASTM D 2270; and sulfur content by any one of ASTM D 2622, ASTM D 4294, ASTM D 4927, or ASTM D 3120.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 10W-60, 15W, 15W-20, 15W-30, 15W-40, 15W-50 or 15W-60. Oils used as gear oils can have viscosities ranging from about 2 cSt to about 2000 cSt at 100° C.

Organic Acid Anhydride

The organic acid anhydrides are anhydrides of carboxylic acids and may be cyclic or linear. The cyclic anhydrides may be aliphatic such as anhydrides of dicarboxylic acids, for example having a two-carbon atom chain separating the carboxyl groups, particular examples of the anhydrides being succinic anhydride and maleic anhydride; or the cyclic anhydrides may be aromatic for example phthalic anhydride. The linear anhydrides may be symmetrical anhydrides of monocarboxylic acids or mixed anhydrides of different monocarboxylic acids.

Without being bound by any theory, it is believed that the anhydrides, in operation in lubricants and to achieve the performance benefits described herein, are convertible to carboxylic acids carrying at least one said aliphatic hydrocarbyl substituent group.

In one embodiment, the organic acid anhydride compound can be a compound of the general structural Formula 1 below:

(Formula 1)

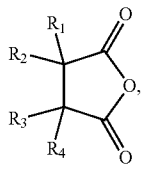

wherein each $R^1$, $R^2$, $R^3$, and $R^4$, when present, are independently a hydrogen radical, or a hydrocarbyl or hydrocarbylene radical, with at least one of $R^1$, $R^2$, $R^3$, and $R^4$ being a hydrocarbyl or hydrocarbylene radical. In one embodiment, the hydrocarbyl and hydrocarbylene radicals as described for $R^1$, $R^2$, $R^3$, and $R^4$ can independently be an alkyl or alkylene radical having from 1 to 400 carbon atoms. In another embodiment, the hydrocarbyl and hydrocarbylene radicals as described for $R^1$, $R^2$, $R^3$, and $R^4$ can independently be an alkyl or alkylene radical having a number average molecular weight from about 350 to about 5000, from about 700 to about 3000, or from about 900 to about 2500. For $R^1$, $R^2$, $R^3$, and $R^4$, the alkyl or alkylene radicals include a polybutyl moiety, fatty acid moieties (i.e., those derived from fatty acids), or isoaliphatic acid moieties (e.g., those derived from 8-methyloctadecanoic acid). In one embodiment, at least one of $R^1$, $R^2$, $R^3$, and $R^4$ is a dodecenyl radical. In one embodiment, at least one of $R^1$, $R^2$, $R^3$, and $R^4$ is an octadecenyl radical. In one embodiment, at least one of $R^1$, $R^2$, $R^3$, and $R^4$ is a tetrapropenyl radical. In another embodiment, one of $R^1$ and $R^2$ and/or $R^3$ and $R^4$ can be bonded to the carbon atom to which it is attached by way of a double bond. For example, $R^1$ can be bonded to the carbon atom to which it is attached by way of a double bond and $R^2$ is not present; and/or $R^3$ can be bonded to the carbon atom to which it is attached by way of a double bond and $R^4$ is not present.

In one embodiment, the organic acid anhydride compound is a reaction product of polyisobutylene (PIB) and maleic anhydride.

The reaction products of polyisobutylenes and maleic anhydride of the present disclosure may be represented by either Formula 2 or Formula 3, as listed below:

(Formula 2)

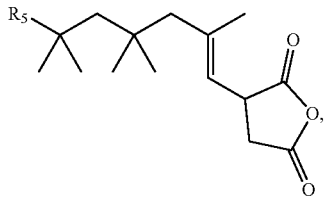

(Formula 3)

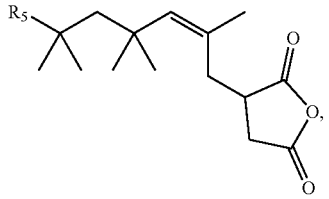

wherein $R^5$ is a polyisobutylene (PIB) chain.

The $R^5$ of Formula 1 and/or Formula 2 is a PIB chain. Suitable PIBs that many constitute the chain may be any PIBs that have a number average weight of about 200 to about 5000 Daltons, preferably from about 500 to about 4500 Daltons, particularly preferably from about 1000 to about 3500 Daltons.

The reaction product of a PIB and maleic anhydride of the present disclosure can be prepared by known procedures. For example, an HR-PIB precursor of Formula 2 and/or Formula 3 can be prepared by a cationic polymerization process, at a temperature that is predetermined according to the desired molecular weight for the PIB oligomer. For example, a PIB that has an average molecular weight of about 2300 Daltons can be prepared at a temperature of about 5° F. A catalyst such as $BF_3$ is often used to advance the polymerization. Following the reaction, the catalyst is typically removed, for example, by extracting the catalyst dissolved in a hot distilled water phase. In another aspect of the polymerization process, the feed into the reactor may include materials such as hexanes and isopropanol. The unreacted residuals of reactive materials, including the unreacted isobutylene monomers, are often removed or purified from the PIB oligomers according to known methods, such as, for example, by flashing in a flash drum and/or using an extraction column. Some HR-PIBs are also commercially available, for example, under the trade name of GLISSOPAL™ (by BASF®).

Reaction products of such HR-PIBs and maleic anhydride can be prepared according to known methods. For example, the succinic anhydride derivative of PIB (i.e., PIBSA—polyisobutylene succinic anhydride) can be prepared in accordance with methods described in U.S. Pat. Nos. 6,245,724, 6,933,351, 6,156,850, and others. To the extent they do not conflict with the disclosures and claims herein, the relevant contents of these patents are incorporated by reference. Specifically, a PIBSA can be prepared using a catalyzed "thermal" or "ene" process, wherein the polyisobutylene is reacted with maleic anhydride at an elevated temperature in the presence of sulfonic acid or one or more other strong-acid. This process is capable of producing PIBSAs with a range of apparent succinic ratios. Such ratios may be adjusted to attain the desired apparent succinic ratios by modifying reaction parameters such as, for example, the length of time it takes to inject the sulfonic acid or one or more strong acids into the reactor, the maleic anhydride:PIB charge mole ratio, and the reaction hold time. Persons skilled in the art would understand that the apparent succinic ratio is preferably in the range of between about 1 and about 2, preferably between about 1.2 to about 1.6, more preferably between about 1.3 and about 1.4. Various PIBSA products can also be obtained from commercial vendors such as Chevron Oronite Company LLC.

Other organic acid anhydrides useful in the present disclosure may be commercially available or may be made by methods known to those skilled in the art.

The organic acid anhydride is present in an amount of from 0.01 to 10, from 0.02 to 5, from 0.02 to 1, 0.05 to 0.50, from 0.1 to 0.50 weight % of the lubricant, based on the total weight of the lubricant.

Secondary and/or Tertiary Hydrocarbyl Amine Compounds

The secondary and/or tertiary amine compounds are useful for increasing the TBN of lubricating oil compositions without introducing sulfated ash.

Thus, in an aspect the secondary hydrocarbylamine is a compound having the following formula (4):

$$R^6R^7NH \qquad \text{(Formula 4)},$$

wherein $R^6$ and $R^7$ are the same or different and each individually are selected from the group consisting of straight-chain or branched, saturated or unsaturated $C_1$-$C_{40}$ hydrocarbyl group.

In one embodiment, at least one of $R^6$ and $R^7$ is a $C_8$-$C_{40}$ hydrocarbyl group. In another embodiment, at least one of $R^6$ and $R^7$ is a $C_8$-$C_{20}$ hydrocarbyl group. In yet another embodiment, at least one of $R^6$ and $R^7$ is a $C_{12}$-$C_{20}$ hydrocarbyl group.

In one embodiment, at least one of $R^6$ and $R^7$ is a $C_8$-$C_{40}$ straight-chain hydrocarbyl group. In another embodiment, at least one of $R^6$ and $R^7$ is a $C_8$-$C_{20}$ straight-chain hydrocarbyl group. In yet another embodiment, at least one of $R^6$ and $R^7$ is a $C_{12}$-$C_{20}$ straight-chain hydrocarbyl group.

In one embodiment, at least one of $R^6$ and $R^7$ is a $C_8$-$C_{40}$ branched hydrocarbyl group. In another embodiment, at least one of $R^6$ and $R^7$ is a $C_8$-$C_{20}$ branched hydrocarbyl group. In yet another embodiment, at least one of $R^6$ and $R^7$ is a $C_{12}$-$C_{20}$ branched hydrocarbyl group.

In one embodiment, at least one of $R^6$ and $R^7$ is a saturated $C_8$-$C_{40}$ hydrocarbyl group. In another embodiment, at least one of $R^6$ and $R^7$ is a saturated $C_8$-$C_{20}$ hydrocarbyl group. In yet another embodiment, at least one of $R^6$ and $R^7$ is a saturated $C_{12}$-$C_{20}$ hydrocarbyl group.

In one embodiment, at least one of $R^6$ and $R^7$ is an unsaturated $C_8$-$C_{40}$ hydrocarbyl group. In another embodiment, at least one of $R^6$ and $R^7$ is an unsaturated $C_8$-$C_{20}$ hydrocarbyl group. In yet another embodiment, at least one of $R^6$ and $R^7$ is an unsaturated $C_{12}$-$C_{20}$ hydrocarbyl group.

In one embodiment, at least one of $R^6$ and $R^7$ is a saturated $C_8$-$C_{40}$ straight-chain hydrocarbyl group. In another embodiment, at least one of $R^6$ and $R^7$ is a saturated $C_8$-$C_{20}$ straight-chain hydrocarbyl group. In yet another embodiment, at least one of $R^6$ and $R^7$ is a saturated $C_{12}$-$C_{20}$ straight-chain hydrocarbyl group.

In one embodiment, at least one of $R^6$ and $R^7$ is an unsaturated $C_8$-$C_{40}$ straight-chain hydrocarbyl group. In another embodiment, at least one of $R^6$ and $R^7$ is an unsaturated $C_8$-$C_{20}$ straight-chain hydrocarbyl group. In yet another embodiment, at least one of $R^6$ and $R^7$ is an unsaturated $C_{12}$-$C_{20}$ straight-chain hydrocarbyl group.

In one embodiment, at least one of $R^6$ and $R^7$ is a saturated $C_8$-$C_{40}$ branched hydrocarbyl group. In another embodiment, at least one of $R^6$ and $R^7$ is a saturated $C_8$-$C_{20}$ branched hydrocarbyl group. In yet another embodiment, at least one of $R^6$ and $R^7$ is a saturated $C_{12}$-$C_{20}$ branched hydrocarbyl group.

In one embodiment, at least one of $R^6$ and $R^7$ is an unsaturated $C_8$-$C_{40}$ branched hydrocarbyl group. In another embodiment, at least one of $R^6$ and $R^7$ is an unsaturated $C_8$-$C_{20}$ branched hydrocarbyl group. In yet another embodiment, at least one of $R^6$ and $R^7$ is an unsaturated $C_{12}$-$C_{20}$ branched hydrocarbyl group.

In one embodiment, both $R^6$ and $R^7$ are a $C_8$-$C_{40}$ hydrocarbyl group. In another embodiment, both $R^6$ and $R^7$ are a $C_8$-$C_{20}$ hydrocarbyl group. In yet another embodiment, both $R^6$ and $R^7$ is a $C_{12}$-$C_{20}$ hydrocarbyl group.

In one embodiment, both $R^6$ and $R^7$ are a $C_8$-$C_{40}$ straight-chain hydrocarbyl group. In another embodiment, both $R^6$ and $R^7$ are a $C_8$-$C_{20}$ straight-chain hydrocarbyl group. In yet another embodiment, both $R^6$ and $R^7$ are a $C_{12}$-$C_{20}$ straight-chain hydrocarbyl group.

In one embodiment, both $R^6$ and $R^7$ are a $C_8$-$C_{40}$ branched hydrocarbyl group. In another embodiment, both $R^6$ and $R^7$ are a $C_8$-$C_{20}$ branched hydrocarbyl group. In yet another embodiment, both $R^6$ and $R^7$ are a $C_{12}$-$C_{20}$ branched hydrocarbyl group.

In one embodiment, both $R^6$ and $R^7$ are a saturated $C_8$-$C_{40}$ hydrocarbyl group. In another embodiment, both $R^6$ and $R^7$ are a saturated $C_8$-$C_{20}$ hydrocarbyl group. In yet another embodiment, both $R^6$ and $R^7$ are a saturated $C_{12}$-$C_{20}$ hydrocarbyl group.

In one embodiment, both $R^6$ and $R^7$ are an unsaturated $C_8$-$C_{40}$ hydrocarbyl group. In another embodiment, both $R^6$ and $R^7$ are an unsaturated $C_8$-$C_{20}$ hydrocarbyl group. In yet another embodiment, both $R^6$ and $R^7$ are an unsaturated $C_{12}$-$C_{20}$ hydrocarbyl group.

In one embodiment, both $R^6$ and $R^7$ are a saturated $C_8$-$C_{40}$ straight-chain hydrocarbyl group. In another embodiment, both $R^6$ and $R^7$ are a saturated $C_8$-$C_{20}$ straight-chain hydrocarbyl group. In yet another embodiment, both $R^6$ and $R^7$ are a saturated $C_{12}$-$C_{20}$ straight-chain hydrocarbyl group.

In one embodiment, both $R^6$ and $R^7$ are an unsaturated $C_8$-$C_{40}$ straight-chain hydrocarbyl group. In another embodiment, both $R^6$ and $R^7$ are an unsaturated $C_8$-$C_{20}$ straight-chain hydrocarbyl group. In yet another embodiment, both $R^6$ and $R^7$ are an unsaturated $C_{12}$-$C_{20}$ straight-chain hydrocarbyl group.

In one embodiment, both $R^6$ and $R^7$ are a saturated $C_8$-$C_{40}$ branched hydrocarbyl group. In another embodiment, both $R^6$ and $R^7$ are a saturated $C_8$-$C_{20}$ branched hydrocarbyl group. In yet another embodiment, both $R^6$ and $R^7$ are a saturated $C_{12}$-$C_{20}$ branched hydrocarbyl group.

In one embodiment, both $R^6$ and $R^7$ are an unsaturated $C_8$-$C_{40}$ branched hydrocarbyl group. In another embodiment, both $R^6$ and $R^7$ are an unsaturated $C_8$-$C_{20}$ branched hydrocarbyl group. In yet another embodiment, both $R^6$ and $R^7$ are an unsaturated $C_{12}$-$C_{20}$ branched hydrocarbyl group.

In one embodiment, both $R^6$ and $R^7$ are is a $C_1$-$C_6$ hydrocarbyl group. Non-limiting examples include methyl, ethyl, propyl, isopropyl, butyl, sec-butyl, tert-butyl, isobutyl, pentyl, hexyl group.

In one embodiment, at least one of $R^6$ and $R^7$ are derived from a fatty acid source. In another embodiment, both $R^6$ and $R^7$ are derived from a fatty acid source. The fatty acid source can be for example, but not limited to, tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil or mixtures thereof.

Non-limiting examples of secondary amines are: bis (2-ethylhexyl)amine, ditridecylamine, Di-octadecylamine (Armeen 218), Di-cocoalkylamines (Armeen 2C), Dihydrogenated Talloalkylamines (Armeen 2HT), 2-ethylhexyl, hydrogenated tallow amine (Armeen HTL8).

In one embodiment, the secondary amine is an alkoxylated amine. For example, the amine can be ethoxylated or propoxylated. Some nonlimiting examples of alkoxylated amines include: $CH_3(—O—C_2H_4)_xNH$, $C_2H_5(—O—C_2H_4)_x$ NH, $CH_3(—O—C_3H_6)_xNH$, $C_2H_5(—O—C_3H_6)_x$ NH, n-$C_4H_9(—O—C_4H_8)_xNH$, $H(O—C_2H_4)_xNH$, $H(O—C_3H_6)_xNH$ and $H(O—C_4H_8)_xNH$, where x is from 2 to 50.

Thus, in an aspect the tertiary hydrocarbylamine is a compound having the following formula (5):

$$R^8R^9R^{10}N \qquad \text{(Formula 5)},$$

wherein $R^8$, $R^9$, and $R^{10}$ are the same or different and each individually are selected from the group consisting of straight-chain or branched, saturated or unsaturated $C_1$-$C_{40}$ hydrocarbyl group.

In one embodiment, at least one of $R^8$, $R^9$, and $R^{10}$ is a $C_8$-$C_{40}$ hydrocarbyl group. In another embodiment, at least one of $R^8$, $R^9$, and $R^{10}$ is a $C_8$-$C_{20}$ hydrocarbyl group. In yet another embodiment, at least one of $R^8$, $R^9$, and $R^{10}$ is a $C_{12}$-$C_{20}$ hydrocarbyl group.

In one embodiment, at least one of $R^8$, $R^9$, and $R^{10}$ is a $C_8$-$C_{40}$ straight-chain hydrocarbyl group. In another embodiment, at least one of $R^8$, $R^9$, and $R^{10}$ is a $C_8$-$C_{20}$ straight-chain hydrocarbyl group. In yet another embodiment, at least one of $R^8$, $R^9$, and $R^{10}$ is a $C_{12}$-$C_{20}$ straight-chain hydrocarbyl group.

In one embodiment, at least one of $R^8$, $R^9$, and $R^{10}$ is a $C_8$-$C_{40}$ branched hydrocarbyl group. In another embodiment, at least one of $R^8$, $R^9$, and $R^{10}$ is a $C_8$-$C_{20}$ branched hydrocarbyl group. In yet another embodiment, at least one of $R^8$, $R^9$, and $R^{10}$ is a $C_{12}$-$C_{20}$ branched hydrocarbyl group.

In one embodiment, at least one of $R^8$, $R^9$, and $R^{10}$ is a saturated $C_8$-$C_{40}$ hydrocarbyl group. In another embodiment, at least one of $R^8$, $R^9$, and $R^{10}$ is a saturated $C_8$-$C_{20}$ hydrocarbyl group. In yet another embodiment, at least one of $R^8$, $R^9$, and $R^{10}$ is a saturated $C_{12}$-$C_{20}$ hydrocarbyl group.

In one embodiment, at least one of $R^8$, $R^9$, and $R^{10}$ is an unsaturated $C_8$-$C_{40}$ hydrocarbyl group. In another embodiment, at least one of $R^8$, $R^9$, and $R^{10}$ is an unsaturated $C_8$-$C_{20}$ hydrocarbyl group. In yet another embodiment, at least one of $R^8$, $R^9$, and $R^{10}$ is an unsaturated $C_{12}$-$C_{20}$ hydrocarbyl group.

In one embodiment, at least one of $R^8$, $R^9$, and $R^{10}$ is a saturated $C_8$-$C_{40}$ straight-chain hydrocarbyl group. In another embodiment, at least one of $R^8$, $R^9$, and $R^{10}$ is a saturated $C_8$-$C_{20}$ straight-chain hydrocarbyl group. In yet another embodiment, at least one of $R^8$, $R^9$, and $R^{10}$ is a saturated $C_{12}$-$C_{20}$ straight-chain hydrocarbyl group.

In one embodiment, at least one of $R^8$, $R^9$, and $R^{10}$ is an unsaturated $C_8$-$C_{40}$ straight-chain hydrocarbyl group. In another embodiment, at least one of $R^8$, $R^9$, and $R^{10}$ is an unsaturated $C_8$-$C_{20}$ straight-chain hydrocarbyl group. In yet another embodiment, at least one of $R^8$, $R^9$, and $R^{10}$ is an unsaturated $C_{12}$-$C_{20}$ straight-chain hydrocarbyl group.

In one embodiment, at least one of $R^8$, $R^9$, and $R^{10}$ is a saturated $C_8$-$C_{40}$ branched hydrocarbyl group. In another embodiment, at least one of $R^8$, $R^9$, and $R^{10}$ is a saturated $C_8$-$C_{20}$ branched hydrocarbyl group. In yet another embodiment, at least one of $R^8$, $R^9$, and $R^{10}$ is a saturated $C_{12}$-$C_{20}$ branched hydrocarbyl group.

In one embodiment, at least one of $R^8$, $R^9$, and $R^{10}$ is an unsaturated $C_8$-$C_{40}$ branched hydrocarbyl group. In another embodiment, at least one of $R^8$, $R^9$, and $R^{10}$ is an unsaturated $C_8$-$C_{20}$ branched hydrocarbyl group. In yet another embodiment, at least one of $R^8$, $R^9$, and $R^{10}$ is an unsaturated $C_{12}$-$C_{20}$ branched hydrocarbyl group.

In one embodiment, at least two of $R^8$, $R^9$, and $R^{10}$ is a $C_8$-$C_{40}$ hydrocarbyl group. In another embodiment, at least two of $R^8$, $R^9$, and $R^{10}$ is a $C_8$-$C_{20}$ hydrocarbyl group. In yet another embodiment, at least two of $R^8$, $R^9$, and $R^{10}$ is a $C_{12}$-$C_{20}$ hydrocarbyl group.

In one embodiment, at least two of $R^8$, $R^9$, and $R^{10}$ is a $C_8$-$C_{40}$ straight-chain hydrocarbyl group. In another embodiment, at least two of $R^8$, $R^9$, and $R^{10}$ is a $C_8$-$C_{20}$ straight-chain hydrocarbyl group. In yet another embodiment, at least two of $R^8$, $R^9$, and $R^{10}$ is a $C_{12}$-$C_{20}$ straight-chain hydrocarbyl group.

In one embodiment, at least two of $R^8$, $R^9$, and $R^{10}$ is a $C_8$-$C_{40}$ branched hydrocarbyl group. In another embodiment, at least two of $R^8$, $R^9$, and $R^{10}$ is a $C_8$-$C_{20}$ branched hydrocarbyl group. In yet another embodiment, at least two of $R^8$, $R^9$, and $R^{10}$ is a $C_{12}$-$C_{20}$ branched hydrocarbyl group.

In one embodiment, at least two of $R^8$, $R^9$, and $R^{10}$ is a saturated $C_8$-$C_{40}$ hydrocarbyl group. In another embodiment, at least two of $R^8$, $R^9$, and $R^{10}$ is a saturated $C_8$-$C_{20}$ hydrocarbyl group. In yet another embodiment, at least two of $R^8$, $R^9$, and $R^{10}$ is a saturated $C_{12}$-$C_{20}$ hydrocarbyl group.

In one embodiment, at least two of $R^8$, $R^9$, and $R^{10}$ is an unsaturated $C_8$-$C_{40}$ hydrocarbyl group. In another embodiment, at least two of $R^8$, $R^9$, and $R^{10}$ is an unsaturated $C_8$-$C_{20}$ hydrocarbyl group. In yet another embodiment, at least two of $R^8$, $R^9$, and $R^{10}$ is an unsaturated $C_{12}$-$C_{20}$ hydrocarbyl group.

In one embodiment, at least two of $R^8$, $R^9$, and $R^{10}$ is a saturated $C_8$-$C_{40}$ straight-chain hydrocarbyl group. In another embodiment, at least two of $R^8$, $R^9$, and $R^{10}$ is a saturated $C_8$-$C_{20}$ straight-chain hydrocarbyl group. In yet another embodiment, at least two of $R^8$, $R^9$, and $R^{10}$ is a saturated $C_{12}$-$C_{20}$ straight-chain hydrocarbyl group.

In one embodiment, at least two of $R^8$, $R^9$, and $R^{10}$ is an unsaturated $C_8$-$C_{40}$ straight-chain hydrocarbyl group. In another embodiment, at least two of $R^8$, $R^9$, and $R^{10}$ is an unsaturated $C_8$-$C_{20}$ straight-chain hydrocarbyl group. In yet another embodiment, at least two of R, $R^9$, and $R^{10}$ is an unsaturated $C_{12}$-$C_{20}$ straight-chain hydrocarbyl group.

In one embodiment, at least two of $R^8$, $R^9$, and $R^{10}$ is a saturated $C_8$-$C_{40}$ branched hydrocarbyl group. In another embodiment, at least two of $R^8$, $R^9$, and $R^{10}$ is a saturated $C_8$-$C_{20}$ branched hydrocarbyl group. In yet another embodiment, at least two of $R^8$, $R^9$, and $R^{10}$ is a saturated $C_{12}$-$C_{20}$ branched hydrocarbyl group.

In one embodiment, at least two of $R^8$, $R^9$, and $R^{10}$ is an unsaturated $C_8$-$C_{40}$ branched hydrocarbyl group. In another embodiment, at least two of $R^8$, $R^9$, and $R^{10}$ is an unsaturated $C_8$-$C_{20}$ branched hydrocarbyl group. In yet another embodiment, at least two of $R^8$, $R^9$, and $R^{10}$ is an unsaturated $C_{12}$-$C_{20}$ branched hydrocarbyl group.

In one embodiment, at least one of $R^8$, $R^9$, and $R^{10}$ is a $C_1$-$C_6$ hydrocarbyl group. Non-limiting examples include methyl, ethyl, propyl, isopropyl, butyl, sec-butyl, tert-butyl, isobutyl, pentyl, hexyl group.

In one embodiment, at least one of $R^8$, $R^9$, and $R^{10}$ is derived from a fatty acid source. In another embodiment, at least two of $R^8$, $R^9$, and $R^{10}$ is derived from a fatty acid source. The fatty acid source can be for example, but not limited to, tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil or mixtures thereof.

In one embodiment, the tertiary amine can be sterically hindered. In one embodiment the sterically hindered amine compound of general formula (5) is acyclic. The term "acyclic" is intended to mean that the sterically hindered amine compound of general formula (5) is free from any cyclic structures and aromatic structures. The sterically hindered amine compound of general formula (5) can be exemplified by: N-tert-butyl-2-ethyl-N-methyl-hexan-1-amine, tert-amyl-tert-butylamine. N-tert-butylheptan-2-amine.

In one embodiment, the secondary and/or tertiary amine has 1 nitrogen atom. In one embodiment, the secondary and/or tertiary amine has 2 nitrogen atoms. In one embodiment, the secondary and/or tertiary amine has 3 nitrogen atoms. In one embodiment, the secondary and/or tertiary amine has 4 nitrogen atoms.

Alternatively, the secondary and/or tertiary amine compound may be a monomeric cyclic amine compound.

In one embodiment, the monomeric cyclic amine compound has the following formula (6):

(Formula 6)

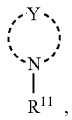

where Y represents the type and number of atoms necessary to complete the cyclic ring. The ring designated by Y may include from 2 to 20, 3 to 15, 5 to 15, or 5 to 10, carbon atoms. The ring designated by Y may be a substituted or unsubstituted, branched or unbranched, divalent hydrocarbon group that includes at least one hetero atom, such as oxygen, or sulfur, and may include at least one heterogroup. In addition to including heteroatoms and/or heterogroups, the ring designated by Y may include at least one hydrocarbyl substituent group. In certain embodiments, the ring designated by Y is free from nitrogen heteroatoms, or free from any heteroatoms. The heteroatoms, heterogroups, and/or substituent groups may be bonded to different atoms in the divalent hydrocarbon group designated by Y.

In formula (6), $R^{11}$ is a hydrogen atom or a hydrocarbyl group. For example, $R^{11}$ may be an alcohol group, an amino group, an alkyl group, an amide group, an ether group, or an ester group. $R^{11}$ may have 1 to 50, 1 to 25, 1 to 17, 1 to 15, 1 to 12, 1 to 8, 1 to 6, or 1 to 4, carbon atoms. $R^{11}$ may be straight or branched. For example, each $R^{11}$ may be an alcohol group, amino group, alkyl group, amide group, ether group, or ester group having 1 to 50 carbon atoms, with the designated functional group (alcohol, etc.), heteroatom, or heterogroup bonded at various positions on the carbon atoms in the backbone.

In one embodiment, the monomeric cyclic amine compound may be exemplified by general formula (7):

(Formula 7)

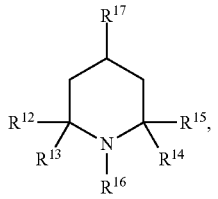

In general formula (7), $R^{12}$, $R^{13}$, $R^{14}$, $R^{15}$, $R^{16}$, and $R^{17}$ are each independently a hydrogen atom or a hydrocarbyl group having from 1 to 25 carbon atoms. For example, $R^{12}$, $R^{13}$, $R^{14}$, $R^{15}$, $R^{16}$, and $R^{17}$ may independently be substituted with an alcohol group, an amino group, an amide group, an ether group, or an ester group. $R^{12}$, $R^{13}$, $R^{14}$, $R^{15}$, $R^{16}$, and $R^{17}$ may independently have from 1 to 20, 1 to 15, 1 to 12, 1 to 8, 1 to 6, or 1 to 4, carbon atoms. In certain embodiments, at least one group designated by $R^{12}$, $R^{13}$, $R^{14}$, $R^{15}$, $R^{16}$, and $R^{17}$ is unsubstituted. Alternatively, at least two, three, four, five, or six groups designated by $R^{12}$, $R^{13}$, $R^{14}$, $R^{15}$, $R^{16}$, and $R^{17}$ are unsubstituted. Alternatively, still, it is contemplated that one, two, three, four, five, or six groups designated by $R^{12}$, $R^{13}$, $R^{14}$, $R^{15}$, $R^{16}$, and $R^{17}$ are substituted. For example, $R^{12}$, $R^{13}$, $R^{14}$, $R^{15}$, $R^{16}$, and $R^{17}$ may be an alcohol group, amino group, alkyl group, amide group, ether group, or ester group having 1 to 25 carbon atoms, with the designated functional group (alcohol, etc) bonded at various positions on the carbon chain.

In some embodiments, the amine compound, such as the monomeric acyclic amine compound or the monomeric cyclic amine compound, may be a sterically hindered amine compound. The sterically hindered amine compound may have a weight average molecular weight of from 100 to 1200. Alternatively, the sterically hindered amine compound may have a weight average molecular weight of from 200 to 800, or 200 to 600. Alternatively still, the sterically hindered amine compound may have a weight average molecular weight of less than 500.

As used herein, the term "sterically hindered amine compound" means an organic molecule having fewer than two hydrogen atoms bonded to at least one alpha-carbon with reference to a secondary or tertiary nitrogen atom. In other embodiments, the term "sterically hindered amine compound" means an organic molecule having no hydrogen atoms bonded to at least one alpha-carbon with reference to a secondary or tertiary nitrogen atom. In still other embodiments, the term "sterically hindered amine compound" means an organic molecule having no hydrogen atoms bonded to each of at least two alpha-carbons with reference to a secondary or tertiary nitrogen atom.

In one embodiment, the secondary amine is a hindered secondary amine compound.

In one embodiment, the tertiary amine compound is a hindered tertiary amine compound.

The sterically hindered amine compound may have general formula (8) or (9):

(Formula 8)

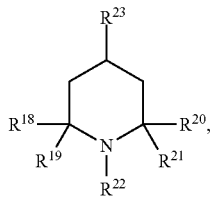

In general formula (8). $R^{18}$, $R^{19}$, $R^{20}$, $R^{21}$, and $R^{22}$ are each independently a hydrogen atom or a hydrocarbyl group having from 1 to 25 carbon atoms, wherein at least two of $R^{18}$, $R^{19}$, $R^{20}$, $R^{21}$, and $R^{22}$ are an alkyl group in one molecule; and $R^{23}$ is independently a hydrogen atom or a hydrocarbyl group having from 1 to 25 carbon atoms.

Each $R^{18}$, $R^{19}$, $R^{20}$, $R^{21}$, $R^{22}$, and $R^{23}$ may independently substituted with an alcohol group, an amide group, an ether group, or an ester group, and each $R^{18}$, $R^{19}$, $R^{20}$, $R^{21}$, $R^{22}$, and $R^{23}$ may independently have from 1 to 25, 1 to 20, 1 to 15, 1 to 12, 1 to 8, 1 to 6, or 1 to 4, carbon atoms.

In certain embodiments, at least one group designated by $R^{18}$, $R^{19}$, $R^{20}$, $R^{21}$, $R^{22}$, and $R^{23}$ is unsubstituted. Alternatively, at least two, three, four, five, or six groups designated by $R^{18}$, $R^{19}$, $R^{20}$, $R^{21}$, $R^{22}$, and $R^{23}$ are unsubstituted. In other embodiments, every group designated by $R^{18}$, $R^{19}$, $R^{20}$, $R^{21}$, $R^{22}$, and $R^{23}$ is unsubstituted. Alternatively, still it is contemplated that one, two, three, four, five, or six groups designated by $R^{18}$, $R^{19}$, $R^{20}$, $R^{21}$, $R^{22}$, and $R^{23}$ are substituted.

Exemplary $R^{18}$, $R^{19}$, $R^{20}$, $R^{21}$, $R^{22}$, and $R^{23}$ groups may be independently selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, or n-octadecyl.

In general formula (8), at least two, at least three, or all four groups, designated by $R^{18}$, $R^{19}$, $R^{20}$, $R^{21}$, and $R^{22}$ are each independently an alkyl group.

The sterically hindered amine compound of general formula (8) may be exemplified by the following compounds: 2,2,6,6-tetramethyl-4-octylpiperdine, 2,2,6,6-tetramethyl-4-decylpiperdine, 2,2,6,6-tetramethyl-4-butylpiperdine, 2,2,6,6-tetramethyl-4-hexadecylpiperdine.

The sterically hindered amine compound may alternatively be exemplified by the general formula (9):

(Formula 9)

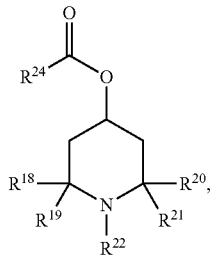

where $R^{18}$, $R^{19}$, $R^{20}$, $R^{21}$, and $R^{22}$ are as described above, wherein at least three of $R^{18}$, $R^{19}$. $R^{20}$, $R^{21}$, and $R^{22}$ are each independently an hydrocarbyl group. $R^{24}$ is a hydrocarbyl group having from 1 to 25 carbon atoms. It can be straight-chain or branched, saturated or unsaturated hydrocarbyl group. The sterically hindered amine compound of general formula (9) may be exemplified by the following compounds: (1,2,2,6,6-pentamethyl-4-piperdyl)octanoate, (1,2,2,6,6-pentamethyl-4-piperdyl)decanoate, (1,2,2,6,6-pentamethyl-4-piperdyl)dodecanoate, (2,2,6,6-tetramethyl-4-piperdyl)decanoate, or C12-21 and C18 unsaturated fatty acids 2,2,6,6-tetramethyl-4-piperidinyl esters (SABO® STAB UV 91, CAS #167078-06-0).

The sterically hindered amine compound may alternatively be exemplified by the general formula (10):

(Formula 10)

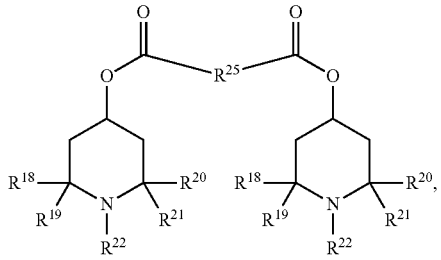

where $R^{18}$, $R^{19}$, $R^{20}$, $R^{21}$, and $R^{22}$ are as described above, wherein at least three of $R^{18}$, $R^{19}$, $R^{20}$, $R^{21}$, and $R^{22}$ are each independently an hydrocarbyl group. $R^{25}$ is a $C_1$-$C_{25}$ hydrocarbyl group. Nonlimiting examples of structures according to formula (10) include: Bis(1,2,2,6,6-pentamethyl-4-piperdinyl)sebacate (SABO® STAB UV 65) and Bis(2,2,6,6-tetramethyl-4-piperdinyl)sebacate (SABO® STAB UV 65), both available from Sabo and Vanderbilt Chemicals, LLC.

The sterically hindered amine compound may include a single ester group. However, the sterically hindered amine compound may alternatively be free from ester groups. In certain embodiments, the sterically hindered amine compound may include at least one, or only one, piperidine ring.

In one embodiment, the tertiary amine is an alkyl di-alkanolamine. Such alkyl di-alkanolamines include, but are not limited to, di-ethanolamines derived from coconut oil. Typically, the alkyl group in coconut oil comprises mixtures of caprylyl, capryl, lauryl, myristyl, palmityl stearyl, oleyl and linoleyl.

In one embodiment, the tertiary amine is an alkyl di-alkanolamine having the following formula (11):

(Formula 11)

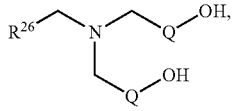

where $R^{26}$ has from 1 to 30 carbon atoms; preferably wherein $R^{26}$ has from 6 to 22 carbon atoms; more preferably, where $R^{26}$ has from about 8 to about 18 carbon atoms and where Q is a $C_1$ to $C_4$ linear or branched alkylene group. In one embodiment, $R^{26}$ has 17 carbon atoms. In another embodiment, $R^{26}$ has 11 carbon atoms.

In one embodiment, the di-alkanolamine comprises a bis-ethoxy alkylamine. For example, the bis-ethoxy alkylamine has the following formula (12):

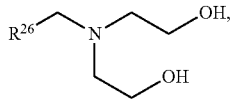

(Formula 12)

where $R^{26}$ comprises 1 to 30 carbon atoms; preferably where $R^{26}$ comprises 6 to 22 carbon atoms; more preferably, where $R^{26}$ comprises from about 8 to about 18 carbon atoms. In one embodiment, $R^{26}$ has 17 carbon atoms. In another embodiment, $R^{26}$ has 11 carbon atoms.

The alkyl group of the di-alkanolamides and di-alkanolamines can have varying levels of unsaturation. For example, the alkyl group can comprise double and triple bonds.

Typically, alkyl di-alkanolamines are commercially available from Akzo Nobel. For example, products sold under the tradename Ethomeen® C/12, Propomeen® T12, or Ethomeen® O/12 are suitable di-alkanolamines for use in the present disclosure.

Examples of alkyl alkanolamines include but are not limited to the following: Oleyl diethanolamine, dodecyl diethanolamine, 2-ethylhexyl diethanolamine, diethanolamine derived from coconut oil and diethanolamine derived from beef tallow and the like.

The tertiary amine may be prepared by methods that are well known in the art. Alkyl di-alkanolamines may be prepared according to U.S. Pat. Nos. 4,085,126; 7,479,473 and other methods that are well known in the art; or, they may be purchased from Akzo Nobel.

Other suitable amines suitable for use in the present disclosure are described in U.S. Pat. No. 9,145,530, US 20130252865, US 20140051621, US 20140106996 the disclosures of which is incorporated herein by reference.

In some embodiments, the secondary and/or tertiary amine does not contain an aromatic group. In some embodiments, the secondary and/or tertiary amine has one aromatic group and the other substituents (i.e., 1 or 2 depending on amine) are branched alkyl groups.

The secondary and/or tertiary amine compounds may have a weight average molecular weight of from 100 to 1200, 200 to 800, or 200 to 600. Alternatively, the monomeric cyclic amine compound may have a weight average molecular weight of less than 500, or at least 50. In some embodiments, the monomeric cyclic amine compound is free from aromatic groups, such as phenyl and benzyl rings. In other embodiments, the monomeric cyclic amine compound is aliphatic.

The monomeric cyclic amine compound may include two or fewer nitrogen atoms per molecule. Alternatively, the monomeric cyclic amine compound may include only one nitrogen per molecule. The phrase "nitrogen per molecule" refers to the total number of nitrogen atoms in the entire molecule, including the body of the molecule and any substituent groups. In certain embodiments, the monomeric cyclic amine compound includes one or two nitrogen atoms in the cyclic ring of the monomeric cyclic amine compound.

Non-limiting examples of tertiary amines are: N, N-dimethyl-N-(2-ethylhexyl)amine, N, N-dimethyl-N-(2-propylheptyl)amine, dodecyldimethylamine (Armeen® DM 12D), octadecyldimethylamine (Armeen® DM18D), hexadecyldimethylamine, oleyldimethylamine (Armeen® DMOD), cocoyldimethylamine (Armeen® DMCD), hydrogenated talloalkyldimethylamines (Armeen® DMHTD), dicocoylmethylamine (Armeen® M2C), tallowdimethylamine, ditallowmethylamine (Armeen® M2HT), tridodecylamine (Armeen®312), trihexadecylamine (ARMEEN®316), trioctadecylamine, soyadimethylamine (Armeen® DMSD), tris(2-ethylhexyl)amine, 2-Ethylhexyl(tallow)methylamine (Armeen® MHTL8), dodecyldimetylamine (Armeen® DM12D), octadecyldimethylamine (Armeen® DM18D), Cocoalkyldimetylamine (Armeen® DMCD), Hydrogenated Tallowalkyldimethylamines (Armeen® DMHTD), Oleylalkyldimethylamine (Armeen® DMOD), Soyaalkyldimethylamines (Armeen® DMSD), and Alamine 336 (tri-n-octylamine).

In certain embodiments, the secondary and/or tertiary hydrocarbylamine compound has a TBN value of at least 20 mg KOH/g when tested according to ASTM D2896, a TBN value of at least 30 mg KOH/g when tested according to ASTM D2896, a TBN value of at least 40 mg KOH/g when tested according to ASTM D2896, a TBN value of at least 60 mg KOH/g when tested according to ASTM D2896, a TBN value of at least 80 mg KOH/g when tested according to ASTM D2896. Alternatively, the amine compound has a TBN value of at least 90, at least 100, at least 110, at least 120, at least 130, at least 140, at least 150, or at least 160, mg KOH/g, when tested according to ASTM D2896. Alternatively still, the amine compound may have a TBN value of from 20 to 500, 60 to 300, 80 to 200, 90 to 190, 100 to 180, or 100 to 150, mg KOH g, when tested according to ASTM D2896.

In some embodiments, the secondary and/or tertiary hydrocarbylamine compound does not negatively affect the total base number of the lubricant composition. Alternatively, the secondary and/or tertiary hydrocarbylamine compound may improve the TBN of the lubricant composition by, at least 0.5, at least 0.6, at least 0.7, at least 0.8, at least 0.9, at least 1.0, at least 1.5, at least 2, at least 2.5, at least 3, at least 3.5, at least 4, at least 4.5, at least 5, at least 10, or at least 15, mg KOH/g of the secondary and/or tertiary hydrocarbylamine compound. The TBN value of the lubricant composition can be determined according to ASTM D2896.

If the secondary and/or tertiary hydrocarbylamine compound is included in the additive package, the additive package includes the amine compound in an amount of from 0.1 to 50 wt. %, based on the total weight of the additive package. Alternatively, the additive package may include the secondary and/or tertiary hydrocarbylamine compound in an amount of from 1 to 25, 0, 1 to 15, 1 to 10, 0.1 to 8, or 1 to 5, wt. %, based on the total weight of the additive package.

The lubricating oil composition includes the secondary and/or tertiary hydrocarbylamine compound in an amount of from 0.1 to 25, 0.1 to 20, 0.1 to 15, or 0.1 to 10, wt. %, based on the total weight of the lubricant composition. Alternatively, the lubricant composition may include the secondary and/or tertiary hydrocarbylamine compound in an amount of from 0.5 to 5, 1 to 3, or 1 to 2, wt. %, based on the total weight of the lubricant composition. In another embodiment, the lubricating oil composition may include the secondary and/or tertiary hydrocarbylamine compound in an amount of from greater than 0.1, greater than 0.2, greater than 0.25, greater than 0.3, greater than 0.35, greater than 0.4, greater than 0.45, greater than 0.5 wt. %, based on the total weight of the lubricating oil composition. Combinations of various secondary and/or tertiary hydrocarbylamine compounds are also contemplated.

Thus, in an aspect the present disclosure provides a method for increasing fresh oil TBN of a lubricating oil composition while at the same time improving seal performance in an internal combustion engine operated with a lubricating oil described herein. Also, the present disclosure provides a method of maintaining TBN of a lubricating oil composition while at the same time improving seal performance in an internal combustion engine operated with a lubricating oil as described herein. In one embodiment, the seals are fluoroelastomer seals.

Additional Lubricating Oil Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of 10 to 100 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore, the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure.

Lubricating Oil Baseline Formulation

A lubricating oil composition was prepared by blending together the following components to obtain an SAE 15W-40 viscosity grade formulation:

(a) secondary zinc diaklyldithiophosphate;
(b) magnesium sulfonate detergent;
(c) a borated succinimide dispersant and a borated sulfonate;
(d) a molybdenum-succinimide complex;
(e) Other succinimide based dispersants;
(f) calcium phenate and calcium sulfonates;
(g) an alkylated diphenylamine and hindered phenol antioxidant;
(h) dispersant OCP;
(i) conventional amounts of pour point depressant, viscosity index improver, and foam inhibitor; and
(j) the balance a mixture of Group II base oils.

Comparative Example 1

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g).

Example 1

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 0.05 wt. % of octadecenylsuccinic anhydride.

Example 2

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 0.10 wt. % of octadecenylsuccinic anhydride.

Example 3

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 0.15 wt. % of octadecenylsuccinic anhydride.

Example 4

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 0.3 wt. % of PIBSA derived from 1000 MW PIB.

Example 5

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 0.4 wt. % of PIBSA derived from 1000 MW PIB.

Example 6

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 0.5 wt. % of PIBSA derived from 1000 MW PIB.

Example 7

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 1.5 wt. % of PIBSA derived from 1000 MW PIB.

Example 8

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 1.0 wt. % tetrapropenylsuccinic anhydride (contains minor amount of water in naphthenic base oil).

Example 9

The formulation baseline was duplicated except the presence of 1.105 wt. % of Armeen® M2HT (N-methyl-N,N-ditallowamine, Akzo Nobel, CAS 61788-63-4, total amine value 103-110 mg KOH/g) and 0.80 wt. % tetrapropenylsuccinic anhydride.

Comparative Example 2

The formulation baseline was duplicated except the presence of 0.85 wt. % of Armeen® M2C (dicocoylmethylamine, Akzo Nobel, CAS 61788-62-3, total amine value 137 mg KOH/g).

Example 10

The formulation baseline was duplicated except the presence of 0.85 wt. % of Armeen® M2C (dicocoylmethylamine, Akzo Nobel, CAS 61788-62-3, total amine value 137 mg KOH/g) and 0.2 wt. % of octadecenylsuccinic anhydride.

Comparative Example 3

The formulation baseline was duplicated except the presence of 0.85 wt. % of SABO® STAB UV 91 (2,2,6,6-tetramethyl-4-piperidinyl esters (fatty acid mixture), SABO, CAS 86403-32-9 (equivalent to 167078-06-0), total amine value 128-137 mg KOH/g).

Example 11

The formulation baseline was duplicated except the presence of 0.85 wt. % of SABO® STAB UV 91 (2,2,6,6-tetramethyl-4-piperidinyl esters (fatty acid mixture), SABO, CAS 61788-62-3, total amine value 128-137 mg KOH/g) and 0.2 wt. % of octadecenylsuccinic anhydride.

Comparative Example 4

The formulation baseline was duplicated except the presence of 0.85 wt. % of Propomeen®

T12 (N-tallowalkyl-1,1'-iminobis-2-propanol, Akzo Nobel, CAS 68951-72-4, total amine value 145-152 mg KOH/g).

Example 12

The formulation baseline was duplicated except the presence of 0.85 wt. % of Propomeen® T12

(N-tallowalkyl-1,1'-iminobis-2-propanol, Akzo Nobel, CAS 68951-72-4, total amine value 145-152 mg KOH/g) and 0.2 wt. % of octadecenylsuccinic anhydride.

MTU Seals

The lubricating oil compositions of Examples 1-12 and Comparative Examples 1-4 were tested for compatibility with seals in a MTU bench test by suspending a Viton® fluorocarbon test piece in an oil-based solution heated for 168 hours. The variation in the percent volume change, points hardness change, tensile strength and the elongation rupture of each sample was measured. For tensile strength and elongation rupture, results closer to zero indicate better seal compatibility. The test results for the compatibility test are summarized below in Tables 1-4. It is evident that the examples which contain both an amine and an organic acid anhydride of the disclosure provide superior seal performance.

TABLE 1

| Example | Tensile (MPa) | Elongation Rupture (%) |
|---|---|---|
| Comparative Example 1 | −56.9 | −52.4 |
| Example 1 | −52.6 | −45.8 |
| Example 2 | −48.9 | −45.1 |
| Example 3 | −45.3 | −38.1 |
| Example 4 | −51.1 | −47.6 |
| Example 5 | −49.6 | −42.9 |
| Example 6 | −44.5 | −40.3 |
| Example 7 | −41.3 | −44.4 |
| Example 8 | −28.6 | −32.2 |
| Example 9 | −22.2 | −23.7 |

TABLE 2

| Example | Tensile (MPa) | Elongation Rupture (%) |
|---|---|---|
| Comparative Example 2 | −55.6 | −64.7 |
| Example 10 | −42.1 | −50.8 |

TABLE 3

| Example | Tensile (MPa) | Elongation Rupture (%) |
|---|---|---|
| Comparative Example 3 | −47.6 | −54.2 |
| Example 11 | −37.3 | −42.7 |

TABLE 4

| Example | Tensile (MPa) | Elongation Rupture (%) |
|---|---|---|
| Comparative Example 4 | −42.1 | −43 |
| Example 12 | −40.5 | −43.8 |

What is claimed is:

1. An internal combustion engine lubricating oil composition which comprises (a) a major amount of an oil of lubricating viscosity;

(b) one or more oil soluble or oil dispersible organic acid anhydrides, said anhydride comprising at least one hydrocarbyl or hydrocarbylene moiety having from about 10 to about 400 carbon atoms; and (c) an oil soluble or oil dispersible secondary hydrocarbylamine compound, a tertiary hydrocarbylamine compound, or combinations thereof, wherein the tertiary hydrocarbylamine compound is an alkoxylated amine.

2. The lubricating oil composition of claim 1, wherein the alkoxylated amine is a compound having the following formula (11):

(Formula 11)

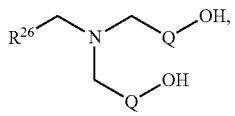

wherein $R^{26}$ has from 1 to 30 carbon atoms; and where Q is a $C_1$ to $_4$ linear or branched alkylene group.

3. The lubricating oil composition of claim 2, wherein the alkoxylated amine is a compound having the following formula (12):

(Formula 12)

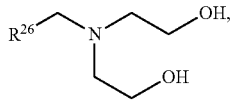

wherein $R^{26}$ comprises 1 to 30 carbon atoms.

4. The composition of claim 1, wherein the organic acid anhydride compound is a compound having the following Formula 1:

(Formula 1)

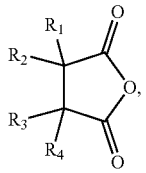

wherein each $R^1$, $R^2$, $R^3$, and $R^4$, when present, are independently a hydrogen radical, or a hydrocarbyl or hydrocarbylene radical, with at least one of $R^1$, $R^2$, $R^3$, and $R^4$ being a hydrocarbyl or hydrocarbylene radical.

5. The composition of claim 4, wherein the hydrocarbyl and hydrocarbylene radicals as described for $R^1$, $R^2$, $R^3$, and $R^4$ can independently be an alkyl or alkylene radical having a number average molecular weight from about 350 to about 5000.

6. The composition of claim 1, wherein the organic acid anhydride compound is a reaction product of polyisobutylene (PIB) and maleic anhydride.

7. The composition of claim 6, wherein the reaction products of polyisobutylenes and maleic anhydride is represented by either Formula 2 or Formula 3:

(Formula 2)

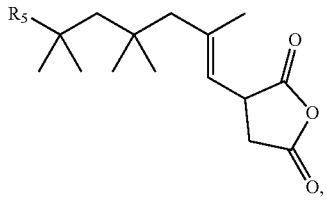

(Formula 3)

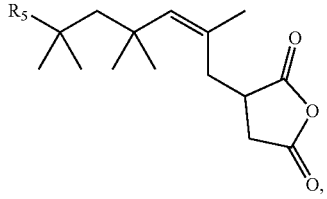

wherein $R^5$ is a polyisobutylene (PIB) chain.

8. The lubricating oil composition of claim 1, wherein [c]has a weight average molecular weight of from 100 to 1200.

9. The lubricating oil composition of claim 1, wherein the [c] has a TBN value of from 20 to 500 mgKOH/g when tested according to ASTM D2896.

10. The lubricating oil composition of claim 1, wherein the secondary hydrocarbylamine compound is a compound having the following formula (4):

$$R^6R^7NH \qquad \text{(Formula 4)},$$

wherein $R^6$ and $R^7$ are the same or different and each individually are selected from the group consisting of straight-chain or branched, saturated or unsaturated $C_1$-$C_{40}$ hydrocarbyl group.

11. An internal combustion engine lubricating oil composition which comprises (a) a major amount of an oil of lubricating viscosity;

(b) one or more oil soluble or oil dispersible organic acid anhydrides, said anhydride comprising at least one hydrocarbyl or hydrocarbylene moiety having from about 10 to about 400 carbon atoms; and (c) an oil soluble or oil dispersible secondary hydrocarbylamine compound, a tertiary hydrocarbylamine compound, or combinations thereof, wherein [c] is a monomeric cyclic amine compound having the following formula (6):

(Formula 6)

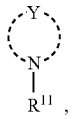

wherein Y represents the type and number of atoms necessary to complete the cyclic ring and is from 2 to 20 carbon atoms, substituted or unsubstituted, branched or unbranched, divalent hydrocarbon group, and $R^{11}$is a hydrogen atom or a hydrocarbyl group.

12. The lubricating oil composition of claim 11, wherein the monomeric cyclic amine compound has the following formula (7):

(Formula 7)

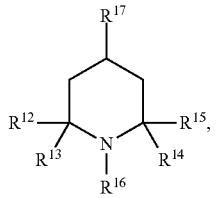

wherein $R^{12}$, $R^{13}$, $R^{14}$, $R^{15}$, $R^{15,16}$, and $R^{17}$ are each independently a hydrogen atom or a hydrocarbyl group having from 1 to 25 carbon atoms.

13. The lubricating oil composition of claim 11, wherein the compound [c] is a compound having the following formula (9):

(Formula 9)

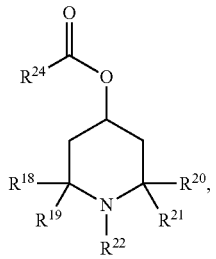

Wherein $R^{18}$, $R^{19}$, $R^{20}$, $R^{21}$, and $R^{22}$ are each independently a hydrogen atom or a hydrocarbyl group having from 1 to 25 carbon atoms, wherein at least two of $R^{18}$, $R^{19}$, $R^{20}$, $R^{21}$, and $R^{22}$ are an alkyl group in one molecule; and $R^{24}$ is a hydrocarbyl group having from 1 to 25 carbon atoms.

14. The composition of claim 11, wherein the organic acid anhydride compound is a compound having the following Formula 1:

(Formula 1)

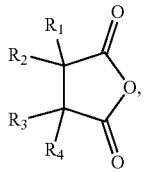

wherein each $R^1$, $R^2$, $R^3$, and $R^4$, when present, are independently a hydrogen radical, or a hydrocarbyl or hydrocarbylene radical, with at least one of $R^1$, $R^2$, $R^3$, and $R^4$ being a hydrocarbyl or hydrocarbylene radical.

15. The composition of claim 14, wherein the hydrocarbyl and hydrocarbylene radicals as described for $R^1$, $R^2$, $R^3$, and $R^4$ can independently be an alkyl or alkylene radical having a number average molecular weight from about 350 to about 5000.

16. The composition of claim 11, wherein the organic acid anhydride compound is a reaction product of polyisobutylene (PIB) and maleic anhydride.

17. The composition of claim 16, wherein the reaction products of polyisobutylenes and maleic anhydride is represented by either Formula 2 or Formula 3:

(Formula 2)

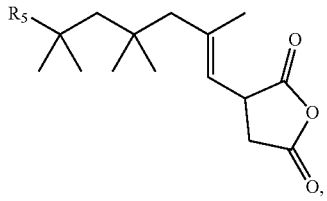

(Formula 3)

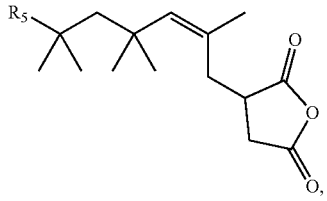

wherein $R^5$ is a polyisobutylene (PIB) chain.

18. The lubricating oil composition of claim 11, wherein [c] has a weight average molecular weight of from 100 to 1200.

19. The lubricating oil composition of claim 11, wherein the [c] has a TBN value of from 20 to 500 mgKOH/g when tested according to ASTM D2896.

20. The lubricating oil composition of claim 11, wherein the secondary hydrocarbylamine compound is a compound having the following formula (4):

$$R^6R^7NH \qquad \text{(Formula 4)},$$

wherein $R^6$ and $R^7$ are the same or different and each individually are selected from the group consisting of straight-chain or branched, saturated or unsaturated $C_1$-$C_{40}$ hydrocarbyl group.

21. A method for increasing fresh oil TBN of a lubricating oil composition while at the same time improving seal performance in an internal combustion engine comprising:

(a) lubricating said engine with a lubricating oil composition according to claim 1 or 11, and (b) operating said engine.

22. A method of maintaining TBN of a lubricating oil composition while at the same time improving seal performance in an internal combustion engine comprising:

(a) lubricating said engine with a lubricating oil composition according to claim 1 or 11, and (b) operating said engine.

23. The method of claim 21 or 22, wherein the seals are fluoroelastomer seals.

* * * * *